US010576001B1

(12) United States Patent
Makins et al.

(10) Patent No.: US 10,576,001 B1
(45) Date of Patent: Mar. 3, 2020

(54) SHOPPING BASKET FOR A POWER CHAIR

(71) Applicants: Jacqueline K. Makins, Piedmont, SC (US); Teddy R. Makins, Piedmont, SC (US)

(72) Inventors: Jacqueline K. Makins, Piedmont, SC (US); Teddy R. Makins, Piedmont, SC (US)

( * ) Notice: Subject to any disclaimer, the term of this patent is extended or adjusted under 35 U.S.C. 154(b) by 98 days.

(21) Appl. No.: 15/792,221

(22) Filed: Oct. 24, 2017

Related U.S. Application Data

(60) Provisional application No. 62/519,303, filed on Jun. 14, 2017.

(51) Int. Cl.
*A61G 5/10* (2006.01)

(52) U.S. Cl.
CPC ..... *A61G 5/1094* (2016.11)

(58) Field of Classification Search
CPC ..... A61G 5/10; A61G 5/1094
USPC ..... 280/304.1
See application file for complete search history.

(56) References Cited

U.S. PATENT DOCUMENTS 2,152,456 A * 3/1939 Barrie ..... A47L 15/50 211/41.4
2,596,055 A 5/1952 Thomas
2,904,237 A * 9/1959 Wasyluk ..... B62B 9/26 224/409
4,140,192 A * 2/1979 Sharpe ..... A61G 5/045 180/6.5
4,158,428 A 6/1979 Bates
4,257,545 A * 3/1981 Rhyan ..... A61G 5/1094 224/407
4,305,601 A * 12/1981 Berge ..... A61G 5/10 280/304.1
4,339,063 A * 7/1982 Trubiano ..... A61G 5/1094 224/407
4,484,755 A 11/1984 Houston
4,526,419 A * 7/1985 Bowman ..... A47C 7/68 224/407
4,580,803 A * 4/1986 Davis ..... A61G 5/10 224/407

(Continued)

FOREIGN PATENT DOCUMENTS

JP 2000005234 A * 1/2000

*Primary Examiner* — Joseph M Rocca
*Assistant Examiner* — Felicia L. Brittman
(74) *Attorney, Agent, or Firm* — Cramer Patent & Design, PLLC

(57) ABSTRACT

A basket for a power chair includes a frame assembly having an inverted "L" shaped first side frame member with a first horizontal frame member and a first vertical frame member, an inverted "L" shaped second side frame member with a second horizontal frame member and a second vertical frame member, and an interconnecting front frame member connected to those ends, and a wire basket. The wire assembly is attached to the frame assembly. Also included is an "L"-shaped first mounting bracket having a hollow first vertical section that receives the first vertical frame member and a first horizontal section, and an "L"-shaped second mounting bracket having a hollow second vertical section that receives the second vertical frame member and a second horizontal section. The first and second horizontal sections are configured to insert into receiver tubes of a power chair.

10 Claims, 3 Drawing Sheets

(56) References Cited

U.S. PATENT DOCUMENTS

| | | | | | |
|---|---|---|---|---|---|
| 4,795,182 | A * | 1/1989 | Dyess | A61G 5/10 | 188/2 F |
| 4,913,393 | A * | 4/1990 | Wood | A61G 5/10 | 224/407 |
| 5,356,059 | A * | 10/1994 | Yanez | A61G 5/10 | 224/407 |
| 5,649,718 | A * | 7/1997 | Groglio | B62B 5/0003 | 280/43.17 |
| 5,794,957 | A * | 8/1998 | Mendon | A61G 5/10 | 280/204 |
| 6,024,527 | A * | 2/2000 | Soriano | B60R 5/04 | 254/10 R |
| 7,500,689 | B2 * | 3/2009 | Pasternak | A61G 5/10 | 280/250.1 |
| 8,794,655 | B1 | 8/2014 | Gipson | | |
| 9,216,120 | B2 * | 12/2015 | Bussinger | A61G 5/10 | |
| 2015/0028073 | A1 * | 1/2015 | Williams | A61G 5/10 | 224/407 |

* cited by examiner

SHOPPING BASKET FOR A POWER CHAIR

RELATED APPLICATIONS

The present invention was first described in and claims the benefit of U.S. Provisional Application No. 62/519,303 filed Jun. 14, 2016, the entire disclosures of which are incorporated herein by reference.

FIELD OF THE INVENTION

The presently disclosed subject matter is directed to power chair devices. More particularly, it is directed to a removable shopping-type basket for a power chair and to power chairs that have that basket.

BACKGROUND OF THE INVENTION

Handicapped people who are confined to powered wheelchairs (often called "power chairs") are often faced with challenges that most people simply do not face. Simply traveling from one place to another can become a major undertaking that requires considerable effort to accomplish. While many people are becoming increasingly aware of and sensitive to issues that the handicap face, and while many people respond in a positive manner, great difficulties still remain.

Among the many difficulties faced by the handicapped is the simple act of shopping. Not only does a disabled person have to get to the store, which maybe a trial in itself, but those confined to a power chair usually have to deal with a shopping cart that is not well-suited to their situation. While simply moving, a shopping cart having a handle that is above them can be difficult, what is worse is that it can be almost impossible for someone seated in a power chair to reach over the shopping cart basket to place something in the bottom of the cart.

While other people can be very helpful, and while the typical power chair bound user is grateful for their help, nonetheless having to rely on others causes many power chair bound users to feel a significant loss of their independence and freedom. Accordingly, there exists a need for a device by which disabled users confined to a power chair are afforded the convenience and functionality of a shopping cart without the disadvantages as described above.

SUMMARY OF THE INVENTION

The principles of the present invention provide for a shopping basket for a power chair. A basket for a power chair that is in accordance with the present invention includes a frame assembly having an inverted "L" shaped first side frame member that is comprised of a forward extending first horizontal frame member and a downward extending first vertical frame member, an inverted "L" shaped second side frame member that is comprised of a forward extending second horizontal frame member and a downward extending second vertical frame member, and an interconnecting front frame member that is connected to the ends of the first and second horizontal frame members. Also included is an open top wire assembly that forms a wire basket. The wire assembly as a bottom perimeter that is attached to the first horizontal frame member, to the second horizontal frame member, and to the front frame member. Also included is an "L"-shaped first mounting bracket having a hollow first vertical section that receives the first vertical frame member and a first horizontal section and an "L"-shaped second mounting bracket having a hollow second vertical section that receives the second vertical frame member and a second horizontal section. The first and second horizontal sections are configured to insert into receiver tubes of a power chair.

The basket for a power chair beneficially has a wire assembly having a front wire wall, a rear wire wall, a first side wire wall, a second side wire wall, and a bottom wire wall that intersect to form a five-sided box. In practice the bottom perimeter aligns with the front frame member. At least the front wire wall is comprised of horizontal wires and vertical wires which are welded together where they intersect. Alternatively, that front wire wall can be comprised of horizontal wires and vertical wires which are soldered together.

In the practice the frame assembly can be comprised of light-weight hollow rectangular tubing. A removable liner that is dimensioned to fit snugly within the wire basket may also be included. If so, strips may be used to secure the liner to the wire basket. A removable release pin which passes through pin apertures in the first vertical section and in the first vertical frame member can be used to retain the frame assembly to the first mounting bracket. If so a safety cord having a hook can be used to retain the release pin in the pin apertures. A fastener which passes through the first horizontal section can be used to connect the first horizontal section to a receiver tube of a power chair.

A power chair assembly that is in accord with the present invention includes a power chair having a seat, an armrest, wheels, and first and second receiver tubes. Also included is a frame assembly having an inverted "L" shaped first side frame member comprised of a forward extending first horizontal frame member and a downward extending first vertical frame member. The frame assembly further includes an inverted "L" shaped second side frame member comprised of a forward extending second horizontal frame member and a downward extending second vertical frame member, and an interconnecting front frame member that is connected to the ends of the first horizontal frame member and the second horizontal frame member. An open top wire basket assembly having a bottom perimeter is attached to the first horizontal frame member, to the second horizontal frame member, and to the front frame member. An "L"-shaped first mounting bracket having a hollow first vertical section receives the first vertical frame member and a first horizontal section is inserted into the first receiver assembly. An "L"-shaped second mounting bracket having a hollow second vertical section receives the second vertical frame member while a second horizontal section is inserted into the second receiver assembly.

The wire basket assembly can include a front wire wall, a rear wire wall, a first side wire wall, a second side wire wall, and a bottom wire wall that intersect to form a five-sided box. In practice the bottom perimeter aligns with the front frame member. At least the front wire wall should be comprised of horizontal wires and vertical wires which are welded together. Also in practice the frame assembly can be comprised of light-weight hollow rectangular tubing. Also included is a removable liner that is dimensioned to fit snugly within the basket assembly. A removable release pin which passes through pin apertures in the first vertical section and in the first vertical frame member can be used to retain the frame assembly to the first mounting bracket. If so a safety cord having a hook can be used to retain the release pin in the pin apertures. In addition, a fastener which passes through the first horizontal section can connect the first horizontal section to the first receiver tube.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
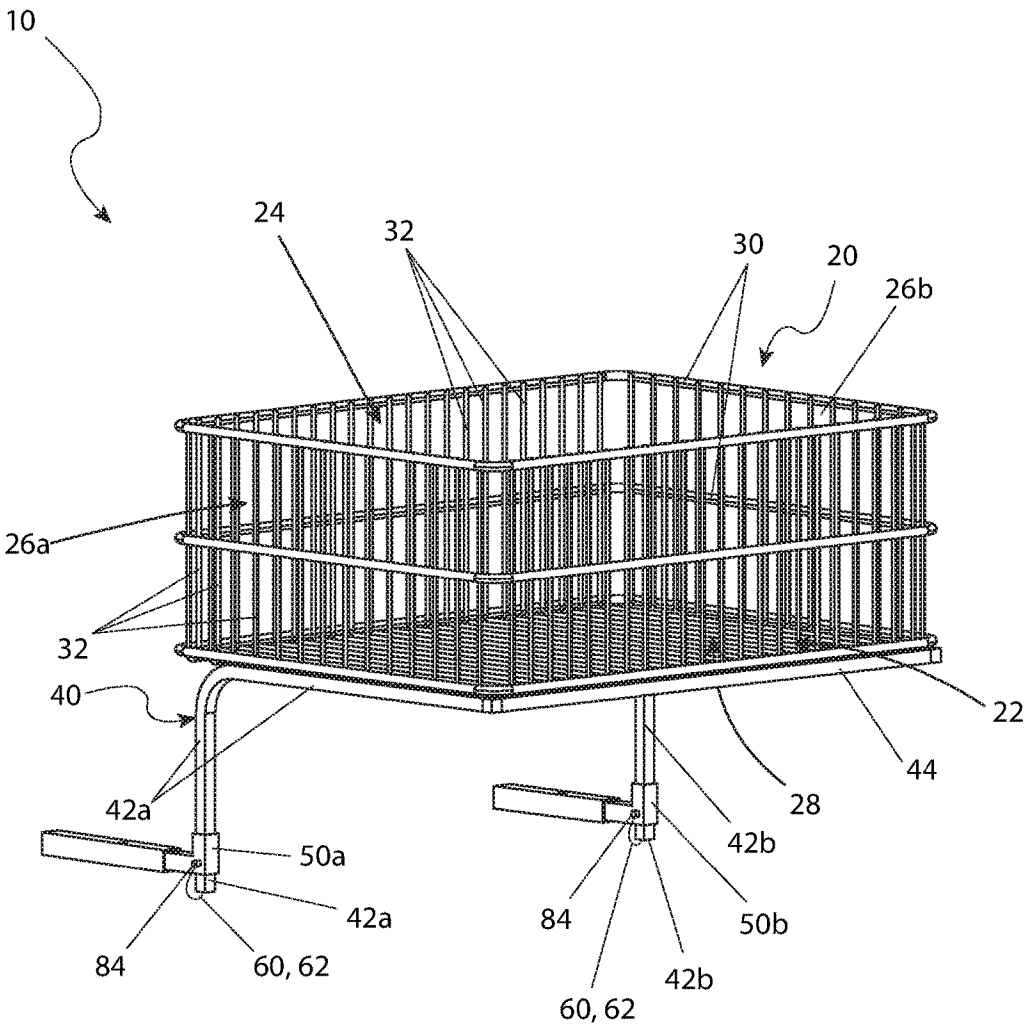
FIG. 1 is a perspective view of a shopping basket for a power chair 10 that is in the accord with the preferred embodiment of the present invention.

10 shopping basket for a power chair
20 basket assembly
22 front wire wall
24 rear wire wall
26*a* first side wire wall
26*b* second side wire wall
28 bottom wire wall
30 horizontal wire
32 vertical wire
40 frame assembly
42*a* first side frame member
42*b* second side frame member
44 front frame member
50*a* first mounting bracket
50*b* second mounting bracket
52 vertical tube section
53 vertical tube aperture
54 horizontal tube section
60 safety cord
62 hook
70 liner
72 VELCRO® strip
80*a* pin aperture
80*b* fastener aperture
82 threaded fastener
83 nut fastener
84 release pin
100 power chair
105 foot rest receiver tube
110 seat
115 seat backrest
120 armrest
125 joystick
130 rear wheel
135 front wheel
140 foot platform

DETAILED DESCRIPTION OF THE PREFERRED EMBODIMENT

Figure 2:
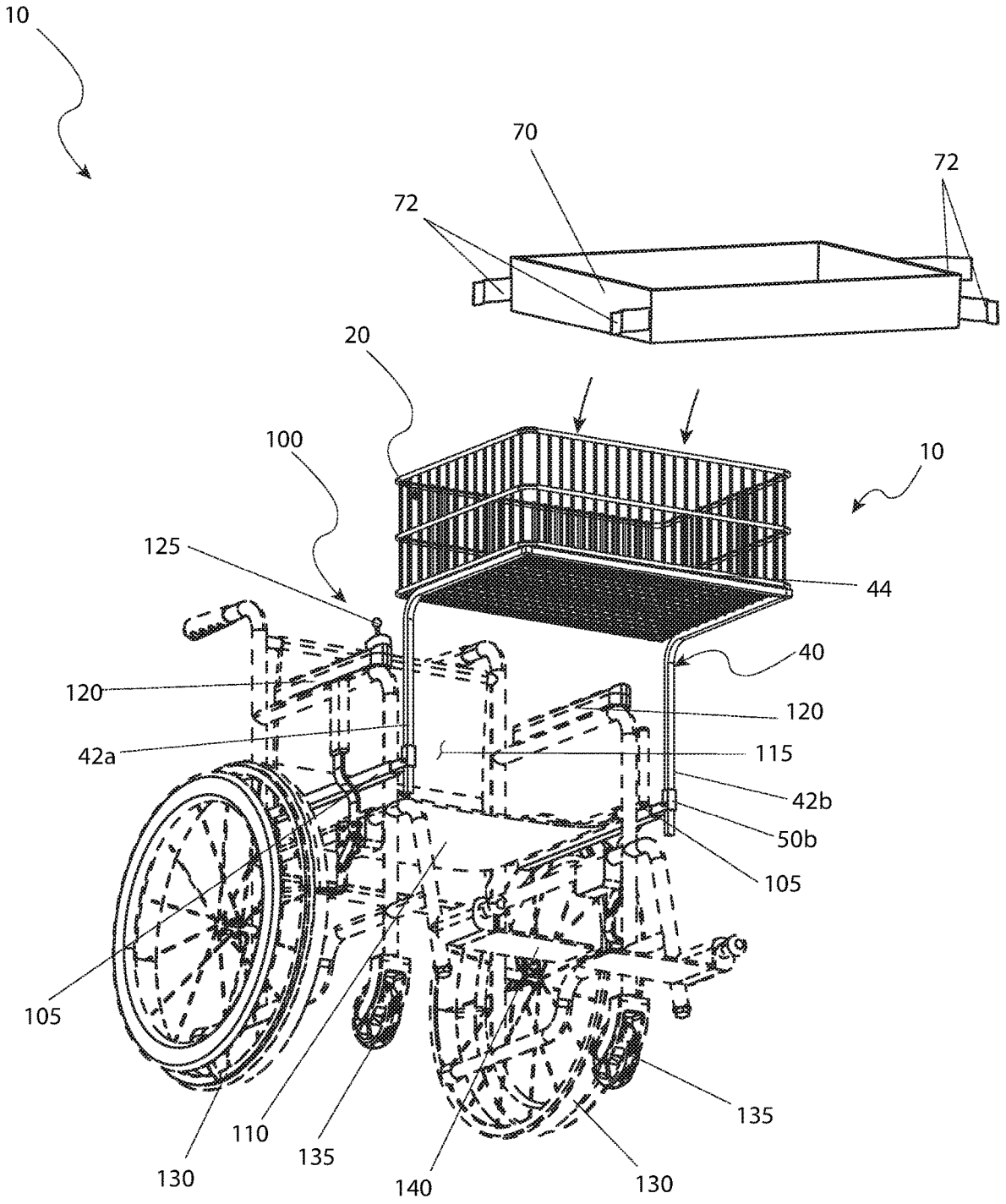
FIG. 2 is an environmental view of the shopping basket for a power chair 10 shown in FIG. 1; and, FIG. 3 presents a close-up view of a mounting bracket that is used in the shopping basket for a power chair 10 shown in FIG. 1 and FIG. 2.
Figure 3:
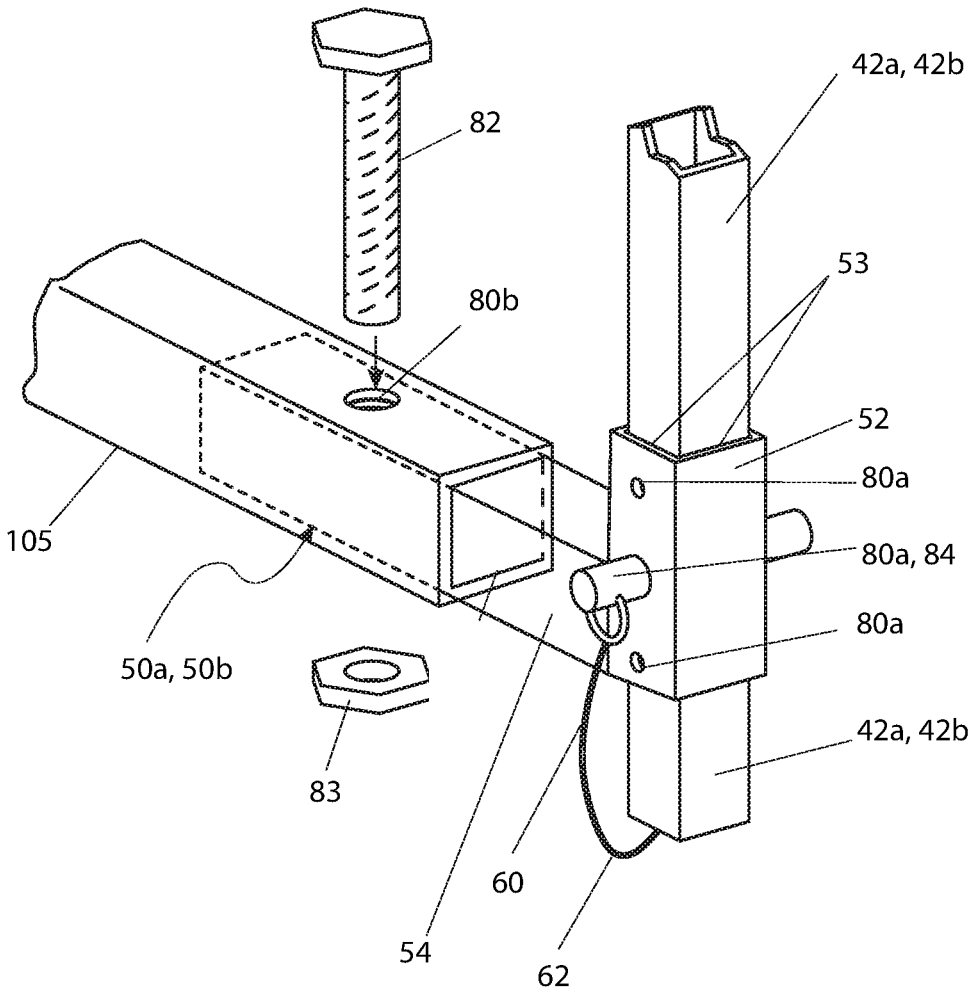

The preferred embodiment of the present invention is depicted in FIGS. 1 through 3. However, the invention is not limited to the specifically described embodiment. A person skilled in the art will appreciate that many other embodiments of the invention are possible without deviating from the basic concept of the invention. Any such work around will also fall under the scope of this invention.

The terms "a" and "an" as used herein do not denote a limitation of quantity, but rather denote the presence of at least one (1) of the referenced items.

The present invention describes a shopping basket 10 for a power chair 100 which implements a wheelchair shopping basket attachment for use by individuals confined to a power chair 100. The shopping basket 10 for a power chair 100 is useful for conveniently transporting a quantity of shopping items, such as groceries and the like, without requiring aid from another person. As shown in FIG. 1 the shopping basket 10 for a power chair 100 includes a rectangular wire-framed basket assembly 20 which attaches to a subjacent tubular frame assembly 40. In turn the frame assembly 40 securely attaches to an existing power chair 100 (see FIG. 2) along opposing sides of the power chair 100 and in front of a seat backrest 115.

Referring back to FIG. 1, the basket assembly 20 has a rectangular welded (or soldered) open-top wire structure that includes a front wire wall 22, a rear wire wall 24, a first side wire wall 26*a*, a second side wire wall 26*b*, and a bottom wire wall 28. The wire walls 22, 24, 26*a*, 26*b*, 28 are comprised of rigid horizontal wires 30 and vertical wires 32 which are welded (or soldered) where they intersect to form a five-sided box. The horizontal and vertical wires 30, 32, and the welding (or soldering) provide sufficient structural strength to safely contain a full load of heavy groceries or other items.

A particular embodiment of the basket assembly 20 has approximate dimensions of nineteen inches (19 in.) in length, thirty-two inches (32 in.) in width, and nine and one-half inches (9½ in.) in depth, however, it should be understood that other models of the shopping basket 10 for a power chair 100 may have different dimensions based upon a user's preferences and the physical characteristics of the power chair 100.

Still referring to FIG. 1, the frame assembly 40 is beneficially constructed to enable quick and easy removal of the basket assembly 20 and frame assembly 40 from the power chair 100 so as to enable a user to easily enter and exit the power chair 100. That construction is discussed in more detail subsequently.

The frame assembly 40 is a one-piece structure comprised of lightweight hollow rectangular tubing. The frame assembly 40 includes an inverted "L" shaped first side frame member 42*a* having a first horizontal frame member and a first vertical frame member, an inverted "L" shaped second side frame member 42*b* having a second horizontal frame member and a second vertical frame member, and an interconnecting front frame member 44. The interconnecting front frame member 44 connects to the ends of the first and second horizontal frame members.

Still referring to FIG. 1, the horizontal frame members of the first and second side frame members 42*a*, 42*b*, extend forward and in parallel. The vertical frame members of the first and second side frame members 42*a*, 42*b* extend downward and in parallel. The bottom perimeter of the basket assembly 20 is welded (or soldered) or otherwise permanently affixed to adjacent portions of the frame assembly 40 such that the bottom perimeter of the front wire wall 22 is aligned with the front frame member 44.

Referring now to both FIG. 1 and FIG. 2, the shopping basket 10 for a power chair 100 further includes "L"-shaped first and second mounting brackets 50*a*, 50*b*. The first and second mounting brackets 50*a*, 50*b* each have a hollow vertical tube section 52 and a hollow horizontal tube section 54.

The vertical frame member of each side frame member 42*a*, 42*b* is slidingly inserted into an associated vertical tube section 52. As described in more detail subsequently, the vertical tube sections 52 support easy removal of the basket assembly 20 and frame assembly 40 from the power chair 100. In addition, and also as described in more detail subsequently, the mounting brackets 50*a* and 50*b* support height adjustability of the basket assembly 20.

The basket assembly 20 and the frame assembly 40 are preferably constructed using light-weight materials such as aluminum, thin-wall steel, or the like. However, it should be understood that various plastic polymers could be used (depending upon loading requirements and dimensions).

Referring now to FIG. 2, the shopping basket 10 for a power chair 100 also includes a rectangular rubber or plastic liner 70. The liner 70 is beneficially dimensioned to fit snugly within the basket assembly 20 and thus against the inner surfaces of wire walls 22, 24, 26*a*, 26*b*, 28. The liner 70 is intended to help with holding meat, dairy products, and the like, and to prevent drips or spills from leaving the basket assembly 20. It is envisioned that the liner 70 would include a plurality of sewn-on VELCRO® strips 72 along its side edge.

The VELCRO® strips 72 would secure the liner 70 to the basket assembly 20 by looping around the horizontal and vertical wires 30, 32 of the basket assembly 20 and then attaching to themselves. Beneficially the height of the liner 70 is approximately one to one-and-a-half inches (1-1½ in.).

Still referring to FIG. 2, a typical power chair 100 includes a seat 110, the seat backrest 115, a pair of armrests 120, a joystick 125, rear wheels 130, front wheels 135, and a foot platform 140. The shopping basket 10 for a power chair 100 is preferably to enable retrofitting to various makes and models of existing power chairs 100. Alternatively, the shopping basket 10 for a power chair 100 may be provided as optional equipment on new power chairs 100.

As noted, the shopping basket 10 for a power chair 100 is removably attached to the existing power chair 100 via the mounting brackets 50*a*, 50*b* which also enable height adjustment of the basket assembly 20 in front of the power chair 100. Referring now also to FIG. 3, the horizontal tube section 54 of each mounting bracket 50*a*, 50*b* is inserted into a foot rest receiver tube 105 of the existing power chair 100 which is typically located subjacent to the seat 110, such as those manufactured by QUANTUM®, PRIDE® MOBILITY PRODUCTS CORP., and others. It is envisioned that different models of the shopping basket 10 for a power chair 100 would be made available for purchase having different mounting brackets 50*a*, 50*b* to fit different makes and models of power chairs 100.

FIG. 3 provides a close-up view of mounting bracket 50*a*, 50*b* of the shopping basket 10 for a power chair 100. The vertical portion of each mounting bracket 50*a*, 50*b* includes a vertical tube section 52 having a vertical tube aperture 53 which is sized to slidingly receive the bottom end of a respective side frame member 42*a*, 42*b*. The side frame members 42*a*, 42*b*, as well as the attached basket assembly 20, are selectively vertically positioned within the mounting brackets 50*a*, 50*b* via insertion of a respective release pin 84 through correspondingly sized and positioned pin apertures 80*a*. The release pin 84 is envisioned as being a commercially-available quick-release-type pin having an integral spring-loaded ball bearing or equivalent securing mechanism.

Each mounting bracket 50*a*, 50*b* includes vertically arranged pin apertures 80*a*. In a similar manner, the bottom end of each side frame member 42*a*, 42*b* includes "opposing" pin apertures 80*a*. In use, each release pin 84 is inserted through aligned pin apertures 80*a* of the mounting brackets 50*a*, 50*b* and the side frame members 42*a*, 42*b*. Each release pin 84 is secured in the pin apertures 80*a* via an elastic safety cord 60. A proximal end of the safety cord 60 is affixed to the release pin 84 while the distal end, which includes a hook 62, engages an open bottom portion of the side frame member 42*a*, 42*b* (or other available attachment points).

The horizontal ends of each mounting bracket 50*a*, 50*b* form a horizontal tube section 54 which is sized and shaped to allow sliding insertion into the foot rest receiver tube 105. Engagement of the horizontal tube sections 54 and the foot rest receiver tubes 105 is locked in place in a semi-permanent manner using at least one (1) threaded fastener 82 and a nut fastener 83 via fastener apertures 80*b*.

The preferred embodiment of the present invention can be used by a common user in a simple and effortless manner with little or no training. After initial purchase or acquisition of the shopping basket 10 for a power chair 100 it would be installed as generally indicated in FIG. 2. This is achieved by procuring a model of the shopping basket 10 for a power chair 100 having a basket assembly 20 with the desired dimensions; installing the mounting brackets 50*a*, 50*b* onto the existing power chair 100 by inserting the horizontal tubing sections 54 of the mounting bracket 50*a*, 50*b* into a respective foot rest receiver tube 105 (located subjacent to the seat 110 of the power chair 100); securing the mounting brackets 50*a*, 50*b* to the foot rest receiver tubes 105 by inserting threaded fasteners 82 through the fastener apertures 80*b* of the mounting brackets 50*a*, 50*b* and foot rest receiver tubes 105 and securing the threaded fasteners 82 with corresponding nut fasteners 83. The shopping basket 10 for a power chair 100 is then ready for receiving the basket assembly 20 and frame assembly 40.

The method of mounting the basket assembly 20 and frame assembly 40 of the shopping basket 10 for a power chair 100 is performed by having a user sit in the seat 110 of the power chair 100 in a normal manner; installing the basket assembly 20 and frame assembly 40, as a unit, to the power chair 100, by inserting the lower ends of the side frame members 42*a*, 42*b* into corresponding vertical tube apertures 53 of each mounting bracket 50*a*, 50*b* while motioning the side frame members 42*a*, 42*b* up and down within the vertical tube apertures 53 as required to obtain the desired height and position relative to the user; securing the side frame members 42*a*, 42*b* within the mounting brackets 50*a*, 50*b* by inserting release pins 84 through the aligned pin apertures 80*a* of the side frame members 42*a*, 42*b* and mounting brackets 50*a*, 50*b*; securing the release pins 84 in position by engaging the hooks 62 of the safety cords 60 to respective side frame members 42*a*, 42*b*; inserting the liner 70 into the basket assembly 20, if desired; and then securing the liner 70 to horizontal and vertical wires 30, 32 of the basket assembly 20 using the VELCRO® straps 72.

With the shopping basket 10 for a power chair 100 installed on a power chair 100 a user can move the power chair 100 while shopping while loading various items into the basket assembly 20, which can then be transported to check out when shopping is complete. The user and/or a helper can then unload the items from the basket assembly 20 at the checkout, load the paid-for items back into the basket assembly 20; transport the paid for goods to a vehicle onto which the goods can be transferred, and finally remove the basket assembly 20 and the frame assembly 40 from the power chair 100 by removing the safety cords 60 and release pins 84 and lifting the basket assembly 20 and frame assembly 40 from the mounting brackets 50*a*, 50*b*. The basket assembly 20 and the frame assembly 40 can then be stored as a unit until needed again. Meanwhile the power chair 100 can be used in a normal manner until such time as the shopping basket 10 for a power chair 100 is once again required for shopping.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A basket for a power chair, comprising:

a frame assembly having an inverted "L" shaped first side frame member comprised of a forward extending first horizontal frame member and a downward extending first vertical frame member, an inverted "L" shaped second side frame member comprised of a forward extending second horizontal frame member and a downward extending second vertical frame member, and an interconnecting front frame member connected to the ends of said first horizontal frame member and said second horizontal frame member;

an open top wire assembly forming a wire basket, said wire assembly having a bottom perimeter attached to said first horizontal frame member, to said second horizontal frame member, and to said front frame member;

an "L"-shaped first mounting bracket having a hollow first vertical section receiving said first vertical frame member and a first horizontal section; and, an "L"-shaped second mounting bracket having a hollow second vertical section receiving said second vertical frame member and a second horizontal section;

further including a removable release pin which passes through pin apertures in said first vertical section and in said first vertical frame member so as to retain said frame assembly to said first mounting bracket;

further including a safety cord having a hook, wherein said safety cord is for retaining said release pin in said pin apertures;

wherein said first and second horizontal sections are configured to insert into receiver tubes of said power chair;

wherein said frame assembly securely attaches to an existing power chair along opposing sides of said power chair and in front of a seat backrest;

wherein said wire assembly includes a front wire wall, a rear wire wall, a first side wire wall, a second side wire wall, and a bottom wire wall that intersect to form a five-sided box;

wherein at least said front wire wall is comprised of horizontal wires and vertical wires which are welded together where they intersect; and wherein said frame assembly is comprised of light-weight hollow rectangular tubing.

2. The basket for a power chair according to claim 1, wherein said bottom perimeter aligns with said front frame member.

3. The basket for a power chair according to claim 1, further including a removable liner dimensioned to fit snugly within said wire basket.

4. The basket for a power chair according to claim 3, further including strips for securing said liner to said wire basket.

5. The basket for a power chair according to claim 1, further including a fastener which passes through said first horizontal section to connect said first horizontal section to a receiver tube of a power chair.

6. A power chair assembly, comprising:

a power chair having a seat, an armrest, wheels, and first and second receiver tubes;

a frame assembly having an inverted "L" shaped first side frame member comprised of a forward extending first horizontal frame member and a downward extending first vertical frame member, an inverted "L" shaped second side frame member comprised of a forward extending second horizontal frame member and a downward extending second vertical frame member, and an interconnecting front frame member connected to the ends of said first horizontal frame member and said second horizontal frame member;

an open top wire basket assembly having a bottom perimeter that is attached to said first horizontal frame member, to said second horizontal frame member, and to said front frame member;

an "L"-shaped first mounting bracket having a hollow first vertical section receiving said first vertical frame member and a first horizontal section that is inserted into a first receiver assembly; and, an "L"-shaped second mounting bracket having a hollow second vertical section receiving said second vertical frame member and a second horizontal section that is inserted into a second receiver assembly;

further including a removable release pin which passes through pin apertures in said first vertical section and in said first vertical frame member so as to retain said frame assembly to said first mounting bracket;

further including a safety cord having a hook, wherein said safety cord is for retaining said release pin in said pin apertures;

wherein at least a front wire wall is comprised of horizontal wires and vertical wires which are welded together; and wherein said frame assembly is comprised of light-weight hollow rectangular tubing.

7. The power chair assembly according to claim 6, wherein said wire basket assembly includes said front wire wall, a rear wire wall, a first side wire wall, a second side wire wall, and a bottom wire wall that intersect to form a five-sided box.

8. The power chair assembly according to claim 7, wherein said bottom perimeter aligns with said front frame member.

9. The power chair assembly according to claim 6, further including a removable liner dimensioned to fit snugly within said basket assembly.

10. The power chair assembly according to claim 6, further including a fastener which passes through said first horizontal section to connect said first horizontal section to said first receiver tube.

* * * * *